US006314693B1

(12) United States Patent
Sanders

(10) Patent No.: US 6,314,693 B1
(45) Date of Patent: Nov. 13, 2001

(54) BUILDING FOUNDATION USING PRE-CAST CONCRETE ELEMENTS

(75) Inventor: Mark E. Sanders, Zionsville, IN (US)

(73) Assignee: Sanders Pre-Cast Concrete Systems., Whitestown, IN (US)

( * ) Notice: Subject to any disclaimer, the term of this patent is extended or adjusted under 35 U.S.C. 154(b) by 0 days.

(21) Appl. No.: 09/669,188

(22) Filed: Sep. 25, 2000

Related U.S. Application Data

(63) Continuation of application No. 09/146,681, filed on Sep. 3, 1998, now Pat. No. 6,131,350.

(51) Int. Cl.[7] ..... E02D 27/00

(52) U.S. Cl. ..... 52/294; 52/293.1; 52/299; 52/741.13; 52/169.1; 52/169.9; 405/229

(58) Field of Search ..... 52/125.1, 125.4, 52/169.9, 292, 293.1, 293.2, 294, 295, 299, 741.13, 745.1, 745.13, 169.1; 405/229

(56) References Cited

U.S. PATENT DOCUMENTS

| | | | | |
|---|---|---|---|---|
| 984,491 | * | 2/1911 | Richmond | 52/125.4 X |
| 1,929,226 | * | 10/1933 | Watkins | 52/295 X |
| 2,110,390 | * | 3/1938 | Charlson | 52/293.2 |
| 2,129,211 | * | 9/1938 | Hickl | 52/299 X |
| 3,561,175 | * | 2/1971 | Best et al. | 52/294 X |
| 3,685,241 | * | 8/1972 | Cooper | 52/293.1 X |
| 3,727,358 | | 4/1973 | Howell . | |
| 3,797,800 | | 3/1974 | Loy . | |
| 3,956,859 | * | 5/1976 | Ingestrom | 52/294 X |
| 4,107,889 | | 8/1978 | Gonsalves et al. . | |
| 4,163,621 | | 8/1979 | Higuchi . | |
| 4,222,208 | * | 9/1980 | Ferver | 52/299 X |
| 4,275,538 | * | 6/1981 | Bounds | 52/299 |
| 4,290,246 | | 9/1981 | Hilsey . | |
| 4,328,651 | | 5/1982 | Gutierrez . | |
| 4,644,718 | | 2/1987 | Burnell et al. . | |
| 4,773,838 | * | 9/1988 | Seppanen . | |
| 4,811,536 | * | 3/1989 | Hardt | 52/295 X |
| 4,817,353 | | 4/1989 | Woods et al. . | |
| 4,901,491 | | 3/1990 | Phillips . | |
| 5,070,672 | * | 12/1991 | Bullivant | 52/169.9 X |
| 5,189,855 | | 3/1993 | Williams et al. . | |
| 5,217,326 | * | 6/1993 | Bullivant | 52/294 X |
| 5,761,862 | * | 6/1998 | Hendershot et al. | 52/294 X |
| 5,924,251 | * | 7/1999 | Jalla | 52/299 X |
| 6,131,350 | * | 10/2000 | Sanders | 52/293.1 |

* cited by examiner

*Primary Examiner*—Robert Canfield
(74) *Attorney, Agent, or Firm*—Baker & Daniels

(57) ABSTRACT

A building foundation is formed by a plurality of pre-cast concrete elements. Each of the pre-cast elements has a length corresponding to the length of a corresponding side or leg of the foundation perimeter. The foundation includes a plurality of pre-cast concrete footing pads that are dispersed along the perimeter and specifically at the corners of the foundation. The pre-cast foundation elements rest on the footing pads and are contiguously arranged to complete the foundation. A bonding agent can be introduced into the joints between adjacent foundation elements to seal the joint. Alternatively, or in addition, mechanical fasteners can be used to interconnect adjacent panels. Certain ones of the pre-cast foundation elements define an integral brick ledge, with varying configurations to ensure continuity of the brick ledge around the corners of the foundation. In a method of the invention, a trench around the perimeter is dug and the pre-cast concrete elements laid in place with a crane.

13 Claims, 3 Drawing Sheets

BUILDING FOUNDATION USING PRE-CAST CONCRETE ELEMENTS

This application is a continuation of application Ser. No. 09/146,681 filed on Sep. 3, 1998, now U.S. Pat. No. 6,131, 350, and is being filed by the inventor named in the co-pending application.

BACKGROUND OF THE INVENTION

The present invention concerns foundations for buildings, such as houses, warehouses and other medium to small sized structures. In particular, the invention concerns a method and components for a below-ground building foundation.

A typical residential structure is supported on a foundation buried below the frost line. In most cases, poured concrete is the material of choice for these foundations. A typical foundation for a residential home is depicted in FIGS. 1 and 2. The foundation 10 is formed around the perimeter of the home layout. In a typical procedure, a trench is dug into the ground G below the frost line, typically to a depth of three feet. A excavator is used to excavate and dig the trench around the foundation perimeter. In the next step, concrete ready-mix trucks deliver concrete to the building site. This concrete is poured into the prepared trenches to form the footing 11. The concrete footing is usually poured to a height of two feet around the entire perimeter of the foundation. The poured concrete is then given a day to cure before subsequent steps are undertaken.

Once the concrete footing 11 has cured, concrete block and cement is again delivered to the building site along with mortar sand. A block mason then installs the concrete or line block 12 on the footing 11. This line block 12 is usually provided in 16-inch lengths. Consequently, several such blocks must be laid by the block mason around the perimeter of the foundation. As shown in FIG. 2, the line blocks 12 are generally centrally situated over the footing 11. Then, additional concrete blocks 13 are installed by the block mason. These blocks 13 typically form the brick ledge, providing about a 4"×4" ledge for orienting subsequent layers of brick for the exterior of the home. As with the line blocks 12, the brick ledge blocks 13 are provided in 16-inch lengths.

Typically, the mortar joints between the concrete blocks are allowed to cure for about one day. Laying of the line and brick ledge blocks is very time consuming, even for a skilled brick mason, often taking two days to complete for a modest residential foundation. Moreover, mortar joints are created along the entire foundation perimeter between the footing 11 and the line blocks 12, between each of the line blocks, between the line blocks and the brick ledge blocks 13, and between adjacent ledge blocks. Statistically, some of the many mortar joints will erode, which may eventually lead to problems with the foundation.

Once the line blocks 12 and brick ledge blocks 13 are laid, the mortar joints are allowed to cure for about a day. Afterwards, an excavator backfills the outer perimeter of the foundation to grade. Loose base material, such as sand or gravel 14, is used to fill the interior of the foundation to provide a base for the floor slab 15. Typically, the slab 15 is also poured concrete. The sand 14 also fills the open portion of the trench behind the blocks 12 and 13. After these steps are completed, the excess sand, block material, cement bags and block skids are cleaned up.

For a typical residential home the process of preparing the foundation can take four to five days. In addition, up to seven different laborers or contractors can be involved to operate the excavator and backfill excavator, deliver the ready-mix, concrete block and mortar, pour the concrete, lay the masonry block and perform various clean up tasks.

Another difficulty arises in the use of poured concrete. In some instances, it is difficult to control the depth, width and height of the poured media. Irregularities in the concrete footing 11 can often be corrected by the block mason when laying the concrete line 12 and brick ledge 13; however, the mortar joints themselves can be subject to irregularities. The make up of the soil itself can pose some difficulties to a poured concrete foundation. For some soils, a rigid form must be placed within the trench to provide a viable channel into which the concrete is poured. Weather also plays a part in the construction of poured concrete foundations. Moisture and temperature can affect the curing time for the concrete and mortar joints. Excessive rain or below-freezing temperatures can delay pouring concrete.

There is always a need for components and methods that streamline the process of preparing a building foundation. A quicker process can lead to significant savings in labor charges, particularly if the number of subcontractors can be reduced. Decreasing the time for building a foundation can also avoid weather-related problems that may delay various steps of the traditional process.

SUMMARY OF THE INVENTION

The difficulties with prior art poured foundations are overcome by the present invention which contemplates a foundation for a building in which the foundation occupies a perimeter defined by a plurality of contiguous sides. The inventive foundation is directed to foundation elements buried within a trench dug along the perimeter at a depth below the frost line. In particular, a plurality of pre-cast concrete panels are provided, one each for each of the plurality of contiguous sides and each having a length approximately equal to the length of the corresponding contiguous side. Each of the pre-cast panels has substantially equal widths and heights from a base to a top side thereof.

In one aspect, the foundation can further include a plurality of pre-cast concrete footing pads each having a width greater than the width of the pre-cast panels, a length substantially less than the length of the panels, and a height that is substantially less than the height of the panels. The combined height of the panels and pads are sized so that when a panel is disposed on a footing pad within the trench the top side of the pre-cast panels is situated adjacent ground level.

In a further feature, a bonding compound is introduced between adjacent ones of the pre-cast panels to form a sealed joint therebetween. Preferably, the bonding compound is an epoxy that is pre-applied or pressure-injected into the minimal spaces between the panels. The bonding compound can also be introduced between the base of each panel and the footing pads; however, it is preferable that the panels simply rest on the pads. Since the panels are as long as a side of the building foundation, the mass of the panels alone is sufficient to maintain solid contact with the footing pads.

In one aspect of the invention, a number of the pre-cast panels defines an integral brick ledge at the top side thereof. The brick ledge can be of a standard configuration to form a ledge upon which exterior brick finishing can be laid. In one specific embodiment, the brick ledge has a depth of about four inches to accommodate a standard brick. Where the foundation includes pre-cast concrete panels having the integral brick ledge, the combined height of the footing pad and foundation panel is sized such that the brick ledge is above ground level when the panel and footing pads are within the foundation trench. The foundation panels can include several anchor bolts projecting from the top side that can be used to anchor framing components for the building.

The present invention contemplates a number of different configurations of pre-cast foundation panels that can be combined in a variety of arrangements depending upon the foundation plan. All of the panels have a length approximately equal to the length of a corresponding side or leg of the foundation perimeter, and substantially equal widths and heights. One group of panels includes an integral brick ledge extending along the entire length of the panel. A second group of panels includes the brick ledge along the length and also extending around one end of the panel. In a third group, the brick ledge is formed at both ends and along the panel length. These groups of pre-cast foundation panels can be laid end-to-end in a manner that ensures continuity of the brick ledge around the comers of the foundation.

In a further aspect of the invention, a method for forming the building foundation is contemplated. In one embodiment, the method includes digging a trench around the perimeter at a depth below the frost line, and laying a plurality of footing pads at spaced intervals within the trench. The method can include placing a layer of fill aggregate at the base of the trench prior to placement of the footing pads. In other embodiments, the footing pads can be eliminated depending upon the nature of the soil and the ability of the excavator or trencher to produce a level, uniform surface for supporting the foundation panels.

According to the method, a plurality of pre-cast concrete foundation panels are provided as described above in which each of the panels has a length substantially equal to the length of a corresponding side or leg of the foundation perimeter. In one embodiment, the panels are produced using a slip-form extruding machine. A continuous length of extruded concrete can be produced and then cut to the particular lengths. The pre-cast foundation panels are lowered into the trench and onto the plurality of pre-cast footing pads. Preferably, a crane is used to remove the panels from a flatbed truck and lower the panels into position. The foundation panels can include eyebolts engaged by tethers carried by the crane.

The foundation panels can be lowered into position almost as quickly as the foundation trench can be dug. Each panel can be guided into contact with an adjacent panel and aligned using a laser. Once all of the panels are in position, a bonding agent can be introduced at the joint between adjacent panels. In one specific embodiment, the bonding agent is a pressure-injected epoxy. As a further alternative, mechanical fasteners can be provided at the joints, particularly at the comer joints, to connect adjacent panels.

It is one object of the invention to provide foundation elements and techniques that greatly facilitate the preparation of a building foundation. A further object is achieved by features of the invention that permit a reduction in the manpower required to construct the foundation.

One benefit of the invention is that a set of pre-cast foundation panels and pads can be provided and carried to a job site for rapid assembly. A further benefit resides in the configuration of the pre-cast foundation panels that can be combined in a variety of ways to create a wide range of foundation layouts.

Other objects and benefits of the invention will be readily discerned from the following written description and accompanying figures.

DESCRIPTION OF THE PREFERRED EMBODIMENT

Figure 1:
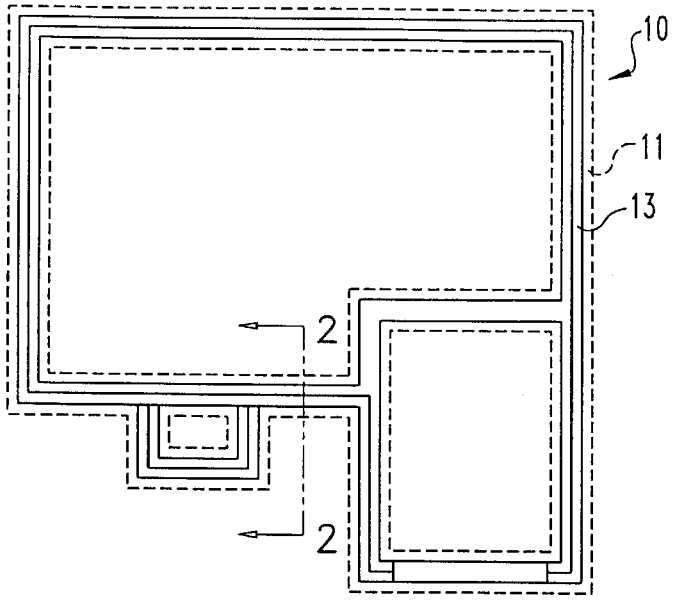
Fig. 1 (PRIOR ART)
FIG. 1 is a plan view of a typical foundation for a residential building.

For the purposes of promoting an understanding of the principles of the invention, reference will now be made to preferred embodiments illustrated in the drawings and specific language will be used to describe the same. It will nevertheless be understood that no limitation of the scope of the invention is thereby intended, such alterations and further modifications in the illustrated embodiment, and such further applications of the principles of the invention as illustrated therein being contemplated as would normally occur to one skilled in the art to which the invention relates.

In a traditional home building process, the building foundation is formed of poured concrete with individual concrete blocks placed on the footing around the perimeter of the foundation. This process usually takes several days and many man hours to complete. In accordance with the present invention, this prior process is greatly streamlined and reduced to a one-day process requiring fewer than half the laborers. In one important aspect of the invention, pre-cast concrete elements are placed within a prepared trench at the perimeter of the foundation. The pre-cast components replace the poured footing and installed concrete line and brick ledge blocks of the prior approaches.

Figure 3:
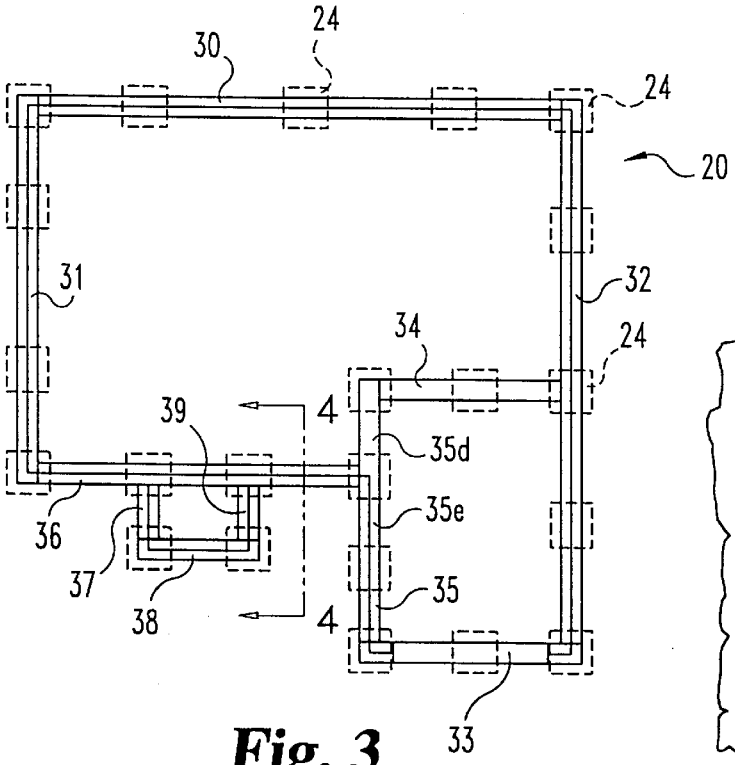
FIG. 3 is a top plan view of a foundation according to one embodiment of the present invention.

In accordance with the invention, a building foundation 20, shown in FIG. 3, is formed by a plurality of pre-cast concrete elements. The pre-cast elements include individual footings 24 and elongated elements 30–39 that are sized to span the entire length of each side of the foundation perimeter. The elongtated pre-cast elements 30–39 are placed in contact around the foundation pattern, usually at the outer corners of the foundation. A joint compound, such as an applied epoxy, is introduced at the junction between adjacent elements to complete the construction.

In accordance with the present invention, a trench is dug in the ground G to the preferred depth below the frost line. In a typical prior art procedure, the trench depth is three feet. In accordance with the present invention, the trench is dug slightly deeper, preferably to a depth of three and one-half to four feet. Once the trench is dug, a layer 22 of compactable fill material can be laid, as may be required by the underlying soil. Typically, the fill material is sand or gravel laid to a depth of about four inches and spanning the entire width of the trench.

In the next step of the preferred method according to the invention, pre-cast footing pads 24 are placed at spaced positions around the perimeter of the foundation. Footing pads 24 are specifically positioned at the corners of the perimeter. In a specific embodiment, these pre-cast footing pads are eighteen inches square and four inches thick. Of course, the dimensions of the footing pads may be modified depending upon the requirements for the particular foundation. Preferably, the footing pads 24 are uniformly placed at eight-foot intervals around the perimeter. Footing pads 24 can be positioned at shorter intervals as may be necessary to provide intermediate support for the pre-cast concrete panels. Since the pre-cast panels 30–39 are as long as each leg or side of the foundation perimeter, the footing pads can be judiciously placed to support the loads transmitted through the panels and to prevent excess bending moments in the panels. The footing pads 24 also serve as a leveling pad to ensure a true foundation. A laser can be used to ensure that the pads 24 along each leg of the foundation perimeter are level. Adjustments to the fill material layer 22 can be made to true up any footing pads.

Once the footing pads 24 have been placed, the individual pre-cast concrete panels 30–39 can be dropped into the trench and placed directly upon the footing pads. In one feature of the present invention, a single pre-cast panel is placed along each continuous leg or side of the building foundation. For instance, in the foundation layout shown in FIG. 3, a single pre-cast panel 30 spans the entire length of the upper leg of the foundation perimeter. In this specific embodiment, this upper leg of the perimeter spans about 43 feet, so that the pre-cast panel 30 has an overall length somewhat less than that dimension. Likewise, a single panel 31 forms the left side of the foundation, while a pre-cast panel 32 spans the right side of the foundation perimeter. In the specific embodiment, the panel 31 has a length of about 28 feet, while the panel 32 has a length of about 38 feet. Additional pre-cast panels 33, 34 and 35 form the perimeter of a garage area. Pre-cast panels 36, 37, 38 and 39 form the front portion of the dwelling foundation and the front porch.

Figure 2:
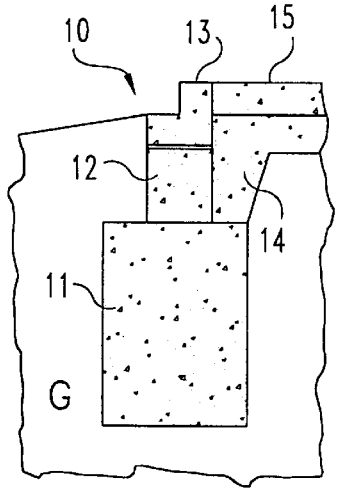
Fig. 2 (PRIOR ART)
FIG. 2 is a side cross-sectional view of the foundation shown in FIG. 1, taken along line 2—2 as viewed in the direction of the arrows.
Figure 4:
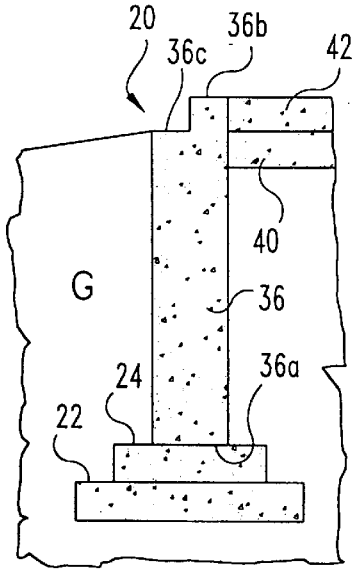
FIG. 4 is a side cross-sectional view of the inventive foundation shown in FIG. 3, taken along line 4—4 as viewed in the direction of the arrows.

As shown in more detail in FIG. 4, in one embodiment, the pre-cast panels take the place of the separate brick ledge 13 of the prior system shown in FIG. 2. For example, the panel 36 forming a portion of the front perimeter of the foundation includes a base 36*a* that rests directly upon the footing pads 24. The top 36*b* extends above the ground level so that the brick ledge 36*c* can be situated at grade level. In other words, the brick ledge is integral with the remainder of the foundation panel. This feature eliminates the need for a brick mason at the construction site, as well as the plurality of line blocks 12 and brick ledge blocks 13 of the prior art building foundations.

Once all of the pre-cast concrete panels are in place within the trench, a bulldozer can be used to backfill around each of the pre-cast foundation components. At this point, granular fill 40, such as sand or gravel, can be placed within the perimeter of the foundation and the slab 42 formed by poured concrete.

Figure 5:
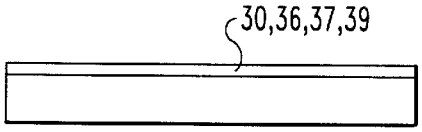
FIG. 5 is a front elevational view of a pre-cast component according to the present invention used in the foundation shown in FIG. 3.
Figure 6:
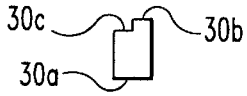
FIG. 6 is an end elevational view of the pre-cast component shown in FIG. 5.

Individual pre-cast concrete panels that are used to form a building foundation according to the present invention are depicted in FIGS. 5–17. It is understood that in the illustrated embodiment, the building foundation requires a brick ledge, so certain of the pre-cast panels will have an integral ledge. Referring now to FIG. 5, the configuration of panels 30, 36, 37 and 39 is shown. With particular reference to the end view shown in FIG. 6, it can be seen that each panel has a base 30*a*, a top 30*b* and a brick ledge 30*c* formed at the top. The brick ledge 30*c* extends along the entire length of the panel 30. This configuration is used at four locations in the foundation shown in FIG. 3. It is understood that each of the panels 30, 36, 37 and 39 can have different lengths, depending upon their position within the building foundation and on the length of the leg or side of the foundation perimeter.

Figure 7:
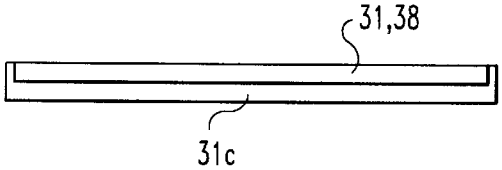
FIG. 7 is a top elevational view of a second pre-cast component according to one embodiment of the present invention used in the building foundation shown in FIG. 3.
Figure 8:
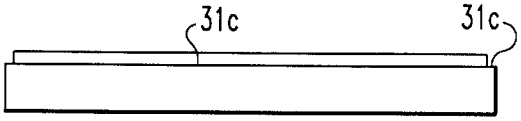
FIG. 8 is a front elevational view of the pre-cast component shown in FIG. 7.
Figure 9:
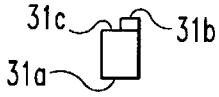
FIG. 9 is an end elevational view of the pre-cast component shown in FIGS. 7 and 8.

A second type of pre-cast panel is shown with reference to FIGS. 7–9. In particular, panels 31 and 38 follow the illustrated configuration in which the brick ledge 31*c* extends along the entire length and along the opposite ends of the panel, as best shown in FIG. 7. As shown in FIG. 3, this panel configuration is arranged to mate with one of the panels 36, 37, or 39, with the base 31*a* and top 31*b* aligned with the corresponding portions of the other panels. With this arrangement, the continuity of the brick ledge is maintained around the corners of the foundation perimeter.

Figure 10:
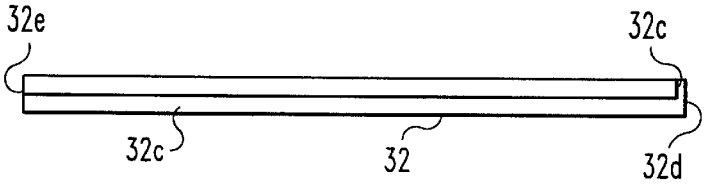
FIG. 10 is a top elevational view of a third pre-cast component used in the building foundation shown in FIG. 3.
Figure 11:
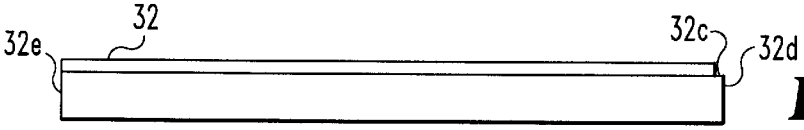
FIG. 11 is a front elevational view of a pre-cast component shown in FIG. 10.

The pre-cast panel 32 as shown in FIGS. 10 and 11 includes the brick ledge 32*c* that extends along the length of the panel and across one end only. This configuration again ensures continuity of the brick ledge around the corners of the foundation perimeter. As shown in FIG. 3, the end 32*d* of the panel 32 having the brick ledge formed on the side mates with a panel 30. At the opposite end 32*e*, where the brick ledge terminates at the side, the panel mates with an additional panel 33.

Figure 12:
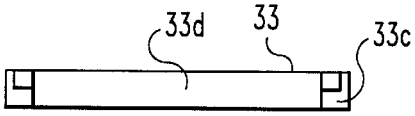
FIG. 12 is a top elevational view of a fourth pre-cast component used in the building foundation shown in FIG. 3.
Figure 13:
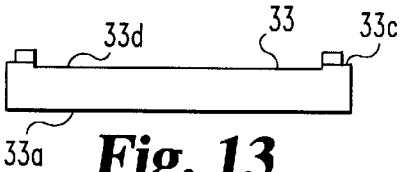
FIG. 13 is a front elevational view of the pre-cast component shown in FIG. 12.

As shown in FIGS. 12 and 13, the panel 33 includes a-brick ledge 33*c* spanning the sides and corners of the panel. It can be noted that the base 33*a* of the panel, as with the bases of the remaining panels, is substantially flat to contact the footing pads 22. The panel 33 also includes a step down portion 33*d*. In the specific embodiment, the step down is a standard four-inch or eight-inch step down as may be found at the entrance to a garage.

Figure 14:
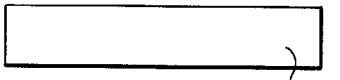
FIG. 14 is a front elevational view of a fifth pre-cast component used in the building foundation shown in FIG. 3.

Looking back at FIG. 3, the back foundation wall for the garage is formed by the panel 34. As shown in FIG. 14, this panel 34 is substantially uniformly rectangular. The panel does not include an integral brick ledge since it is located at the interior portion of the foundation.

Figure 15:
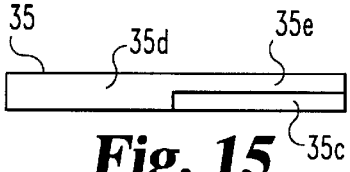
FIG. 15 is a top elevational view of a sixth pre-cast component used in the building foundation shown in FIG. 3.
Figure 16:
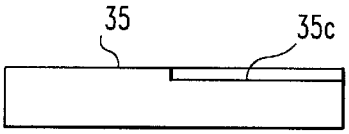
FIG. 16 is a front elevational view of the pre-cast component shown in FIG. 15.
Figure 17:
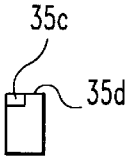
FIG. 17 is an end elevational view of the pre-cast component shown in FIGS. 15 and 16.

The final wall of the garage in the layout shown in FIG. 3 is formed by the panel 35. This panel is illustrated in detail in FIGS. 15–17. The panel 35 includes two segments 35*d* and 35*e*. The segment 35*d* is at the interior of the foundation perimeter, while the segment 35*e* forms an exterior portion of the foundation. Consequently, as shown in FIGS. 15 and 16, the portion 35*d* does not include the integral brick ledge. This portion 35*d* completes the interior foundation wall of the garage along with panel 34. The portion 35*e* includes the brick ledge 35*c* defined from the top edge 35*b* of the panel, since this portion forms an exterior portion of the foundation.

Figure 18:
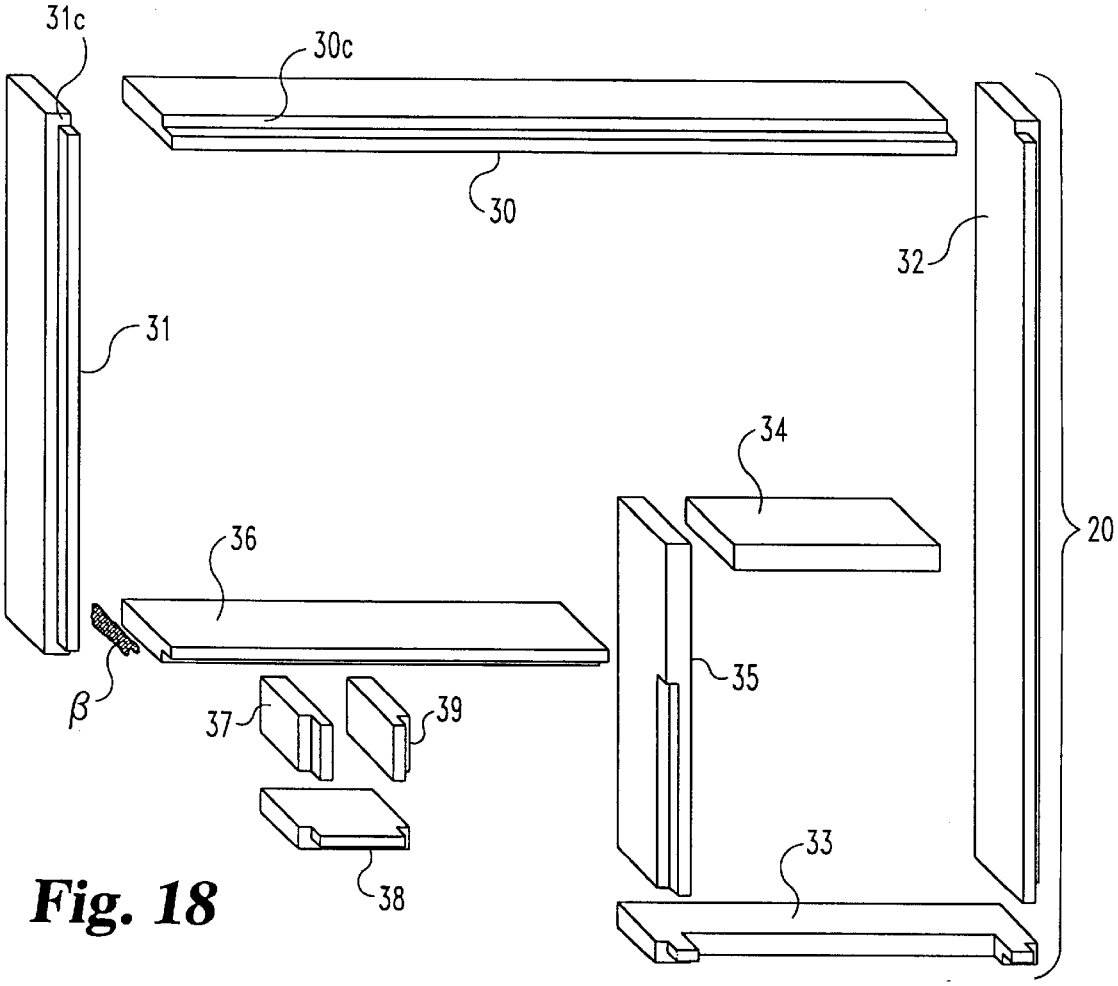
FIG. 18 is an exploded plan view of the pre-cast components depicted in FIGS. 5–17 as used to create the building foundation shown in FIG. 3.

The relationship amongst all of the panels 30–39 described above can be seen in the exploded view of the foundation shown in FIG. 18. In this view, it can be seen that the integral brick ledge of each of the exterior panels unite to form a continuous brick ledge around the perimeter of the foundation, including the corners. It is understood that a wide range of foundation perimeter layouts can be achieved using a combination of the panels 30–39 . For example, a rectangular layout can be created by two panels 30 opposite each other and two opposite panels 31 between the panels 30. Of course, more elaborate configurations can be achieved, with provisions for maintaining the continuity of the brick ledge around comers of the foundation perimeter.

In accordance with the present invention, each of the panels simply rests upon a number of footing pads 22 dispersed along the prepared trench. Since the panels are uniform across their entire length, the overall weight of each panel is sufficient to maintain a tight, essentially impermeable contact with the footing pads 22.

In a further feature of the preferred embodiment, the joint between adjacent panels are filled with some type of bonding material that is usable with concrete or other aggregates, such as the bonding material β depicted in FIG. 18. In one specific embodiment, the bonding material is an epoxy adhesive, such as AKABond 18G prepared by Akemi, Inc. of Eaton Rapids, Mich. This material is a solid gel epoxy adhesive that can be implanted into the joint by a pressure injection method. This epoxy sets in about 20 minutes and has an initial cure time of approximately 24 hours.

Figure 19:
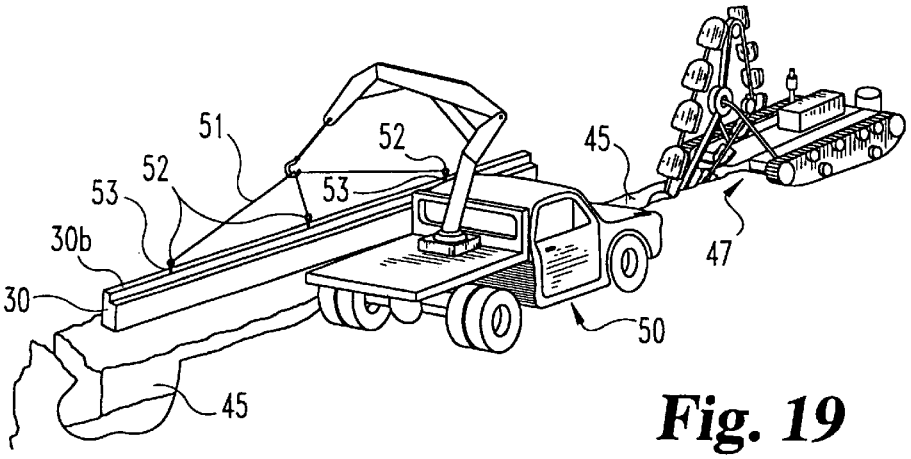
FIG. 19 is a perspective view of steps of the method for building the foundation in accordance with one embodiment of the present invention.

Referring now to FIG. 19, steps of the method according to a preferred embodiment of the invention are illustrated. One advantage achieved by the present invention is that many of the steps of the method can occur substantially simultaneously. With a traditional poured foundation, the foundation trench must be laid out and dug initially before any foundation material can be laid. According to the present invention, an excavator or trencher 47 can be continuously digging the trench 45 while other operations are occurring. The excavator is preferably laser guided so that the trench is dug to a uniform depth relative to the graded surface. Once the excavator finishes digging a continuous leg or side of the foundation perimeter, a pre-cast concrete panel, such as panel 30, can be placed within the trench.

Preferably, the panel is moved into position by a mobile crane 50. One type of crane is depicted in FIG. 19, although other mobile cranes, such as a boom crane, are contemplated. Installing the pre-cast panels into the trench would ordinarily require a crane operator and a worker to guide the panel into position within the trench and centered over the footing pads 22. In a preferred embodiment, the panels are carried by a lifting mechanism, such as a barrier lift. One such lifting mechanism is the BARRIER LIFTALL™ provided by Liftall, Inc., that utilizes gripping pads and a linkage to grasp the sides of the panels.

Alternatively, the crane can support the panel by way of tethers 51 attached to eyebolts 52 projecting from the top edge, such as edge 30*b* of the panel. Preferably, the eyebolts 52 can be engaged to anchor bolts 53 that are embedded within the panel 30. The anchor bolts can be added to a pre-formed panel at the job site, although the bolts are most preferably incorporated when the panel is manufactured. In a specific embodiment, the eyebolts 52 are threaded onto the anchor bolts 53. Alternatively, the anchor bolts can initially include the eyebolt portion for engaging the tethers 51. Once the panel is installed, the eyebolt portion can be sheared or cut off, leaving an exposed bolt shank. The anchor bolts 53 can be subsequently used to anchor wall joists or other components used in framing the structure.

In one embodiment, the pre-cast panels are manufactured at a location remote from the building site. Alternatively, equipment can be provided at the site for producing the pre-cast concrete panels. Of course, the on-site location must have adequate facilities to allow the pre-cast panels to cure. Most preferably, however, the pre-cast panels are manufactured at a more central location and then shipped by flat bed truck to the site. Since the panels are flat, several such panels can be carried per shipment. For example, a single flat bed truck can carry enough panels to form the foundation of three residential houses having the foundation plan shown in FIG. 3.

Preferably, the pre-cast panels are produced using a slip form extrusion apparatus. One such apparatus is an adaptation of a GT-3200 trimmer/slip form paver produced by Gomaco Corporation of Ida Grove, Iowa. Since most of the panels have a uniform cross-section along their length, the slip form technique can be used without modification. In one approach, a continuous length of uniform cross-section is fabricated by the slip form extrusion apparatus. The continuous length can then be cut to appropriate lengths for use with a particular foundation plan. For some of the pre-cast panels, such as panels 31, 32 and 38, additional material would need to be removed in order to present an appropriately formed panel, namely with the brick ledge cutouts at the ends of the panels. This additional material can be removed once the panel has been cut to its appropriate length using traditional concrete cutting techniques. Other types of slip form extrusion devices are contemplated for preparing the pre-cast panels. For instance, an extruder as shown in U.S. Pat. No. 4,773,838 can be modified to produce the panels 30–39 according to the present invention.

In one feature of the invention, a single panel is prepared for each span of the foundation perimeter. In some cases, however, the size of the building may necessitate the use of multiple panels along one side of the foundation perimeter. It has been found that extruded panels up to 45 feet in length can be readily formed and easily transported to the construction site. Panels of greater length may be more difficult to manufacture and would certainly be more troublesome to transport using a traditional flat bed truck. If multiple panels are used to form one side of the foundation, the adjacent panels can be situated flush against each other, with an epoxy compound injected into the longitudinal joint.

The present invention greatly simplifies the task of preparing a building foundation. The invention is particularly applicable to the construction of foundations for residential homes, although the same components and techniques can be utilized for larger structures. The use of pre-cast concrete panels eliminates many steps that are necessary using traditional poured foundation techniques. In addition, the pre-cast panels can take advantage of economies of scale presented by a slip form extrusion apparatus. For example, a typical slip form extruder can extrude up to 180 feet of concrete in a 30-minute period. The extruded panels are cured sufficiently for transport within about a day. For a typical residential development, a single slip forming apparatus can produce all of the pre-cast panels for all of the building foundations with virtually no delay. Moreover, since pre-cast panels are being used, there should be no delay at the job site awaiting the arrival of variety of sub-contractors required for the preparation of a traditional poured foundation.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected.

For example, in one modification, the pre-cast footing pads 24 can be eliminated depending upon the nature of the underlying ground. Hard compacted earth or rock at the base of the foundation trench may adequately support the pre-cast concrete panels 30–39 so that subsidence and shifting will not occur. The layer of fill material 22 can be retained to help level the foundation assembly.

In a further alternative, the footing pads 24 can be integrated into some or all of the pre-cast panels 30–39 . The trench dimensions can be modified to accommodate laying the modified panel.

The preferred embodiment of the present invention contemplates that the pre-cast components are formed of concrete. However, it is envisioned that other castable materials may be utilized to the extent that such materials can be used in the construction of a building foundation. While the preferred embodiment envisions the use of slip forming techniques to create the pre-cast foundation components, other manufacturing approaches may be envisioned, provided that a substantially complete component is available at the job site for placement into the foundation trench.

The preferred embodiment also contemplates the use of an epoxy at the joint between adjacent panels. In the alternative, mechanical fasteners can be employed to interconnect the components. The fasteners can project from the ends of each panel and can be configured for mechanical attachment between each other. A sealing compound and even an epoxy can be introduced within the joint, in combination with the mechanical fasteners.

What is claimed:

1. A foundation for a building in which the foundation occupies a perimeter defined by a plurality of contiguous sides, each of the sides having a length along the perimeter, and in which the foundation is buried in a trench along the perimeter at a depth below the frost line, said foundation comprising:

a plurality of pre-cast panels, one each for each of the plurality of contiguous sides and each having a length approximately equal to the length of the corresponding contiguous side, each of said pre-cast panels having substantially equal widths and heights from a base to a top side thereof; and a plurality of footing pads each having a width greater than the width of said pre-cast panels, a length substantially less than the length of said pre-cast panels, and a height that is substantially less than the height of said pre-cast panels, wherein a combined height of one of said plurality of pre-cast panels and one of said plurality of footing pads is substantially equal to the depth of the foundation trench such that said top side of said plurality of pre-cast panels is situated adjacent ground level when said panels are mounted on corresponding ones of said footing pads within the foundation trench, and further wherein said plurality of pre-cast panels are disposed in contiguous arrangement around the foundation perimeter.

2. The building foundation according to claim 1 further comprising means for fastening adjacent ones of said plurality of panels together within the foundation trench.

3. The building foundation according to claim 2, wherein said means for fastening includes a bonding compound to form a sealed joint therebetween.

4. The building foundation according to claim 1, wherein said plurality of pre-cast panels are formed of concrete.

5. The building foundation according to claim 1, wherein a number of said plurality of pre-cast panels defines an integral brick ledge at said top side thereof, and said combined height is sized such that said brick ledge is above ground level when said panels are mounted on corresponding ones of said footing pads within the foundation trench.

6. The building foundation according to claim 5, wherein a second number of said pre-cast panels includes opposite ends and defines an integral brick ledge at said opposite ends.

7. The building foundation according to claim 5, wherein a further number of said pre-cast panels includes a first portion defining a brick ledge and a second portion that does not define said brick ledge.

8. The building foundation according to claim 1, wherein said pre-cast panels include several anchor bolts projecting from said top side thereof.

9. A method for forming a foundation for a building around a perimeter defined by a plurality of contiguous sides, the method comprising the steps of:

digging a trench around the perimeter, the trench having a depth below the frost line;

laying a plurality of footing pads at spaced intervals within the trench;

providing a plurality of pre-cast panels, each having a length substantially equal to the length of a corresponding side of the foundation perimeter, each of the pre-cast panels having a height approximately equal to the depth of the trench;

laying each of the plurality of pre-cast panels in a portion of the trench at a corresponding one of the contiguous sides, with adjacent ones of the panels in direct contact; and fastening adjacent panels together.

10. The method for forming a foundation according to claim 9, wherein said step of digging a trench includes ensuring that the base of the trench is level.

11. The method for forming a foundation according to claim 9, comprising the step of laying a layer of fill material to a predetermined depth in the trench prior to laying the plurality of footing pads.

12. The method for forming a foundation according to claim 9, wherein the step of providing a plurality of pre-cast panels includes:

extruding a continuous length of concrete in the form of a corresponding pre-cast panel; and cutting the continuous length of concrete to lengths of corresponding sides of the foundation perimeter.

13. The method for forming a foundation according to claim 9, wherein the fastening step includes providing a bonding agent at the joint between adjacent panels.

* * * * *